US010818461B2

(12) United States Patent
Heraud et al.

(10) Patent No.: US 10,818,461 B2
(45) Date of Patent: Oct. 27, 2020

(54) TRIPPING DEVICE FOR AN ELECTRICAL SWITCHING UNIT AND ELECTRICAL SWITCHING UNIT INCLUDING SUCH A TRIPPING DEVICE

(71) Applicant: Schneider Electric Industries SAS, Rueil Malmaison (FR)

(72) Inventors: Sebastien Heraud, Grenoble (FR); Grigori Delcarmine, Grenoble (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 159 days.

(21) Appl. No.: 16/211,804

(22) Filed: Dec. 6, 2018

(65) Prior Publication Data

US 2019/0198275 A1 Jun. 27, 2019

(30) Foreign Application Priority Data

Dec. 21, 2017 (FR) ..... 17 62775

(51) Int. Cl.
*H01H 71/40* (2006.01)
*H01H 71/16* (2006.01)
(Continued)

(52) U.S. Cl.
CPC ..... *H01H 71/40* (2013.01); *H01H 37/52* (2013.01); *H01H 71/08* (2013.01); *H01H 71/16* (2013.01);
(Continued)

(58) Field of Classification Search
CPC ..... H01H 3/001; H01H 71/40; H01H 71/402
See application file for complete search history.

(56) References Cited

U.S. PATENT DOCUMENTS 3,104,297 A 9/1963 Powell et al.
3,303,441 A 2/1967 Paton et al.
3,548,358 A 12/1970 Klein

FOREIGN PATENT DOCUMENTS

BE 693871 7/1967
BE 700982 12/1967
FR 2 043 526 A1 2/1971

OTHER PUBLICATIONS

French Preliminary Search Report dated Sep. 25, 2018 in French Application 17 62775 filed on Dec. 21, 2017 (with English Translation of Categories of Cited Documents and Written Opinion).

*Primary Examiner* — Ramon M Barrera
(74) *Attorney, Agent, or Firm* — Oblon, McClelland, Maier & Neustadt, L.L.P.

(57) ABSTRACT

A thermomagnetic trip assembly includes a thermal trip, a magnetic trip, and first and second actuation levers. The thermal trip includes a bimetal strip that is capable of deforming in order to actuate the first actuation lever. The magnetic trip includes a movable armature, a fixed armature and an electrical conductor. The movable armature is capable of moving in order to actuate the second actuation lever. The electrical conductor and the bimetal strip are electrically connected in series with one another between first and second connection terminals of the trip assembly. The movable armature is connected to the first connection terminal, the fixed armature is connected to the second connection terminal, and the respective contact areas of the fixed armature and of the movable armature are made of electrically conductive materials that exhibit a low degree of mutual weldability.

17 Claims, 5 Drawing Sheets

(51) Int. Cl.

| | |
|---|---|
| ***H01H 71/08*** | (2006.01) |
| ***H01H 37/52*** | (2006.01) |
| *H01H 71/24* | (2006.01) |
| *H01H 3/00* | (2006.01) |

(52) U.S. Cl.
CPC ..... *H01H 3/001* (2013.01); *H01H 71/2472* (2013.01); *H01H 2071/168* (2013.01); *H01H 2201/026* (2013.01)

TRIPPING DEVICE FOR AN ELECTRICAL SWITCHING UNIT AND ELECTRICAL SWITCHING UNIT INCLUDING SUCH A TRIPPING DEVICE

The present invention relates to a tripping device for an electrical switching unit and an electrical switching unit including such a tripping device.

Electrical switching units, such as circuit breakers, make it possible to protect an electrical facility against an electrical fault.

Such an electrical switching unit includes an actuatable cut-off block, capable of interrupting the flow of an electric current, and a trip assembly used to detect an electrical fault and, in response, mechanically actuate the cut-off block in order to interrupt the current.

In practice, a group of several tripping devices from different technologies is used, each being capable of detecting a specific electrical fault. For example, a magnetic trip makes it possible to detect a short-circuit type electrical fault, with a rapid response. A thermal trip makes it possible to detect an overcurrent type fault, with a longer reaction time.

Generally, these two tripping devices are closely associated with one another within the electrical unit. This is then referred to as a thermomagnetic trip.

An example of a thermomagnetic trip assembly is described in the patent EP-2733720-B1.

Known thermal trips include a bimetal strip, i.e. a laminated assembly of two metal strips having different thermal expansion coefficients. In the case of overcurrent, the electric current flowing in the trip expands the two strips by Joule effect, which, due to the different nature thereof, causes the bimetal strip to deform, such as to move an actuating device for the cut-off block.

In practice, in certain architectures, the thermal trip is heated by Joule effect, by directly passing, through the bimetal strip, the electric current which flows in the trip. A consequence is that the bimetal strip carries an electric current, including during a short-circuit type fault.

A disadvantage is that the bimetal strip is not always dimensioned to resist such a short-circuit current, which has a greater intensity than that encountered with overcurrent.

This poses a problem in the case of tripping devices with a small rating, for example rated for a tripping current for overcurrent with an intensity less than or equal to 20 amps, since the bimetal strip must then be designed to deform as soon as a low-intensity fault current occurs. Passing a short-circuit current through the bimetal strip which, under other circumstances would not pose a problem, then causes irreparable problems.

In particular, passing a short-circuit current through the bimetal strip causes a rapid and significant increase in temperature, that is greater than the nominal operating temperatures. This produces mechanical stresses which lead to irreversible deformations of the bimetal strip and of the thermal trip, or even damage to the surrounding mechanical devices. The problem becomes worse in the case of modern ranges of trips which are subject to increased miniaturisation.

In the end, this compromises the thermal tripping function, particularly after short-circuit, thus making the switching unit incapable of fulfilling the role thereof when faced with certain electrical faults, and this is unacceptable.

Therefore, there is a need for a thermomagnetic trip for an electrical switching unit having a small current rating which exhibits satisfactory reliability and durability.

To this end, the invention relates to a thermomagnetic trip assembly for an electrical switching unit, such as a circuit breaker, this assembly comprising:

a thermal trip, a magnetic trip, and a tripping arm intended to be mechanically coupled to a switching mechanism of the electrical switching unit, this tripping arm including first and second actuation levers;

the thermal trip including a bimetal strip that is capable of deforming when the current passing through it exceeds a first predefined threshold, such as to actuate the first actuation lever;

the magnetic trip includes a movable armature, a fixed armature and an electrical conductor;

the movable armature being capable of moving from a first position, in which the movable armature is distanced from the fixed armature, toward a second position, in which the movable armature is in contact with the fixed armature at contact areas, when the current which flows through the electrical conductor exceeds a second predetermined threshold, the movement of the movable armature toward the second position actuating the second actuation lever;

the electrical conductor and the bimetal strip being electrically connected in series with one another between first and second connection terminals of the trip assembly.

According to the invention, the movable armature is connected to the first connection terminal, the fixed armature is connected to the second connection terminal, and the respective contact areas of the fixed armature and of the movable armature are made of electrically conductive materials that exhibit a low degree of mutual weldability.

Thanks to the invention, placing the fixed and movable armatures into contact in the second position allows the electric current to flow between the connection terminals without passing through the bimetal strip. This makes it possible to divert at least some of the electric current from the bimetal strip. The risk of the bimetal strip overheating is therefore reduced. Moreover, the choice of the materials forming the contact area restricts the risk of accidental welding between the fixed and movable armatures during the flow of the electric current. The reliability of the trip assembly is therefore improved.

According to aspects of the invention that are advantageous but not essential, such a trip assembly can incorporate one or more of the following features, taken separately or according to any technically acceptable combination:

The contact areas are formed by an added element, such as a covering, or a plate or a contact pad, fixed on a body of the corresponding fixed or movable armature.

At least one contact area is made of a metal material, chosen from the group including copper, steel, aluminium, Dural alloy, an alloy of aluminium having the French designation A-G3 or A-G4, and the materials of the contact areas which are part of the fixed and movable armatures, respectively, are different.

At least one contact area is made of graphite.

The contact area or areas of the movable armature are directly connected to the first terminal.

The contact area or areas of the fixed armature are directly connected to the second terminal.

The magnetic trip includes a return spring, preferably a coil spring, in order to bring the movable armature back toward the first position, said return spring being coated with an insulating material.

The insulating material is Teflon.

The electrical conductor and the bimetal strip together form a first branch of an electric circuit such that an electric current flows between the connection terminals, whereas, in the second position, the fixed and movable armatures in contact with one another form a second branch of the electric circuit such that an electric current flows between the connection terminals, this second branch being electrically arranged in parallel with the first branch, and whereas the first branch has an impedance greater than the impedance of the second branch, for example an impedance ten times greater than that of the second branch, preferably an impedance one hundred times greater than that of the second branch.

According to another aspect, the invention relates to an electrical switching unit, particularly a circuit breaker, including:

a cut-off block having separable electrical contacts;

a trip assembly capable of triggering the opening of the electrical contacts of the cut-off block when an electrical fault is detected.

According to the invention, the trip assembly of this switching unit is in accordance with the information provided above.

The invention will be better understood and further advantages thereof will emerge more clearly upon reading the following description, of an embodiment of a trip assembly, which description is given solely by way of example and with reference to the appended drawings in which.

Figure 1:
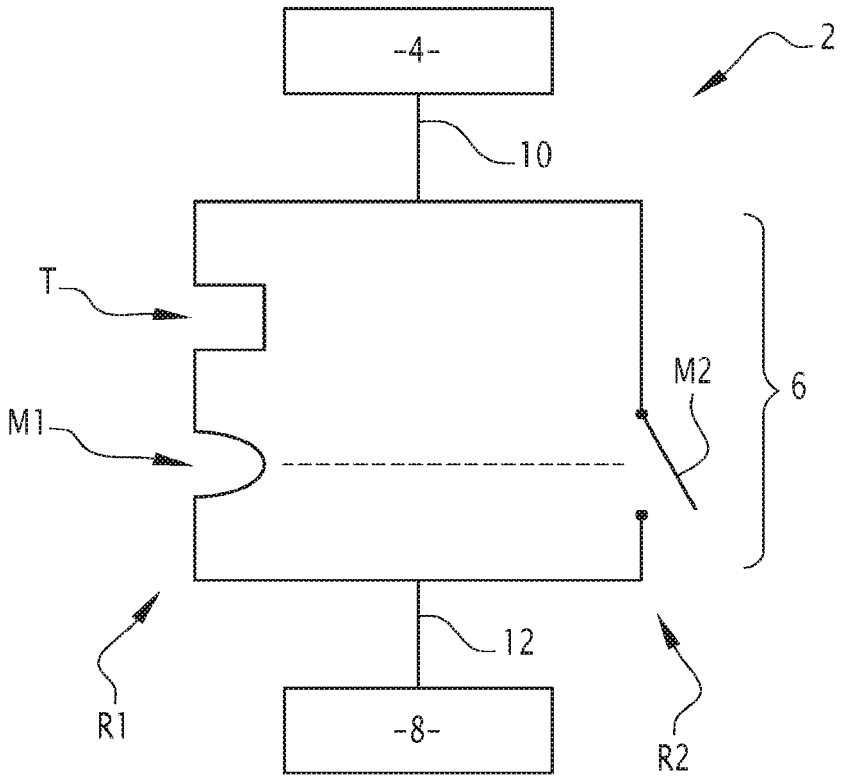
FIG. 1 is a schematic illustration of an electrical switching unit including a trip assembly according to the invention.

FIG. 1 schematically shows an electrical switching unit 2, such as a circuit breaker. For example, it can be a low-voltage circuit breaker.

The unit 2 includes a cut-off block 4 and a trip assembly 6. The unit 2 is intended to be connected to an electrical facility 8 to be protected, called a client facility. The trip assembly 6 includes connection terminals, or plate terminals, denoted 10 and 12, which connect it to the cut-off block 4 and to the client facility 8, respectively. The cut-off block is also connected to a feed line by upstream connection terminals, which are not illustrated.

In a known manner, the cut-off block 4 makes it possible to interrupt the current when it is triggered by the assembly 6. For example, the cut-off block 4 includes separable electrical contacts which can be moved between an open state and a closed state.

The assembly 6 is set up to monitor the electric current which flows toward the facility 8 and, in the case of electrical fault, to trigger the opening of the cut-off block 4. The electrical fault can be an overload current or a short-circuit.

The assembly 6 in this case includes a thermomagnetic trip, formed by grouping together a thermal trip and a magnetic trip, each preferably being capable of detecting a type of electrical fault.

For example, the assembly 6 is a tripping device with a small rating, the tripping intensity "Ir" of which, for example, is less than or equal to 20 amps.

An example of implementing the assembly 6 is described with reference to FIGS. 2-6.

In the following example, the assembly 6 is described for a single electrical pole of the unit 2. In practice, the unit 2 can be a multipole unit, intended to protect a polyphase electrical facility. In this case, the assembly 6 is modified accordingly.

The assembly 6 includes a casing 14, for example a casing moulded from plastic. This casing 14 contains the components of the assembly 6.

The assembly 6 includes a thermal trip, a magnetic trip and a tripping arm 20 intended to be mechanically coupled to a switching mechanism of the unit 2, for example to a known energy storage mechanism.

The tripping arm 20 includes a first actuation lever 22 and a second actuation lever 24, which are associated with the magnetic trip and the thermal trip, respectively. When either of the actuation levers 22 and 24 is moved by the corresponding trip, the tripping arm 20 rotates and activates the switching mechanism in order to open the contacts of the cut-off block such as to interrupt the flow of the current in the unit 2. For example, the tripping arm 20 is a shaft mounted rotatably with respect to the casing 14.

The thermal trip includes a bimetal strip 30, i.e. a laminated assembly of two metal strips having different thermal expansion coefficients. This bimetal strip 30 is intended to carry a current which flows between the terminals 10 and 12, as explained hereafter. The bimetal strip 30 is capable of deforming when the current that passes through it exceeds a first predefined threshold, such as to actuate the first actuation lever 24.

For example, the bimetal strip 30 extends from a base of the casing 14 toward an upper face of the casing 14. The upper end of the bimetal strip 30 is free to move when the bimetal strip deforms and is placed opposite the actuation lever 24.

The first threshold corresponds, for example, to a tripping threshold for a temporally long fault of overload current type.

The magnetic trip includes a movable armature 34, a fixed armature 32 and an electrical conductor 36.

The electrical conductor 36 and the bimetal strip 30 are electrically connected in series with one another between the connection terminals 10 and 12. Advantageously, the conductor 36 plays the role of an additional heating element for the bimetal strip 30.

For example, the bimetal strip 30 is kept in direct contact with a curved portion of the terminal 12 by tightening via a metal screw 31, in this case at the base of the bimetal strip 30.

The movable armature 34 is capable of moving from a first position toward a second position when the current which flows through the electrical conductor 36 exceeds a second predetermined threshold. In the first position, the movable armature 34 is distanced from the fixed armature 32. In the second position, the movable armature 34 is in contact with the fixed armature 32. The contact is produced at contact areas of the armatures 32 and 34.

Figure 2:
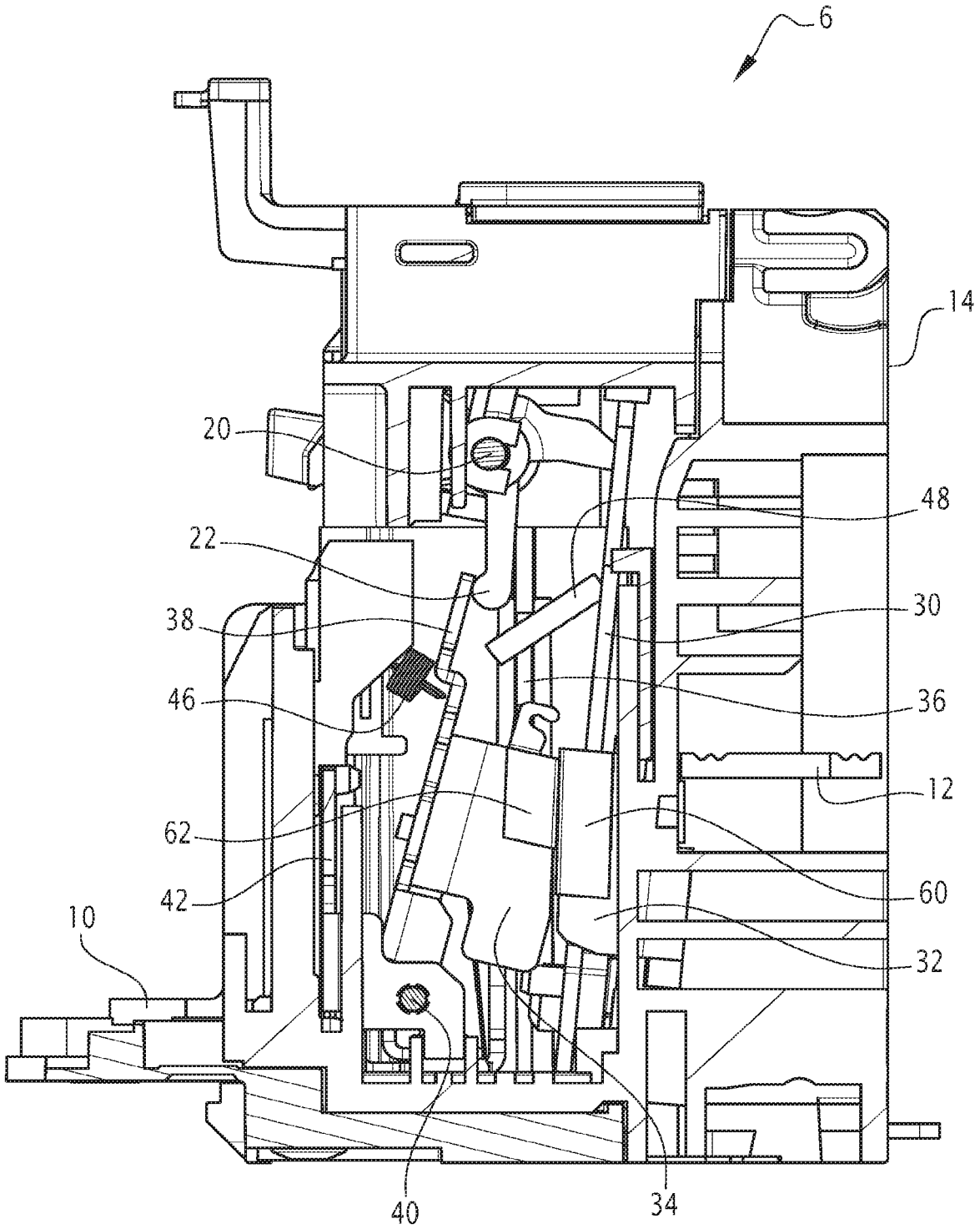
FIG. 2 is a schematic representation, seen in profile, of an example of a trip assembly according to the invention.
Figure 3:
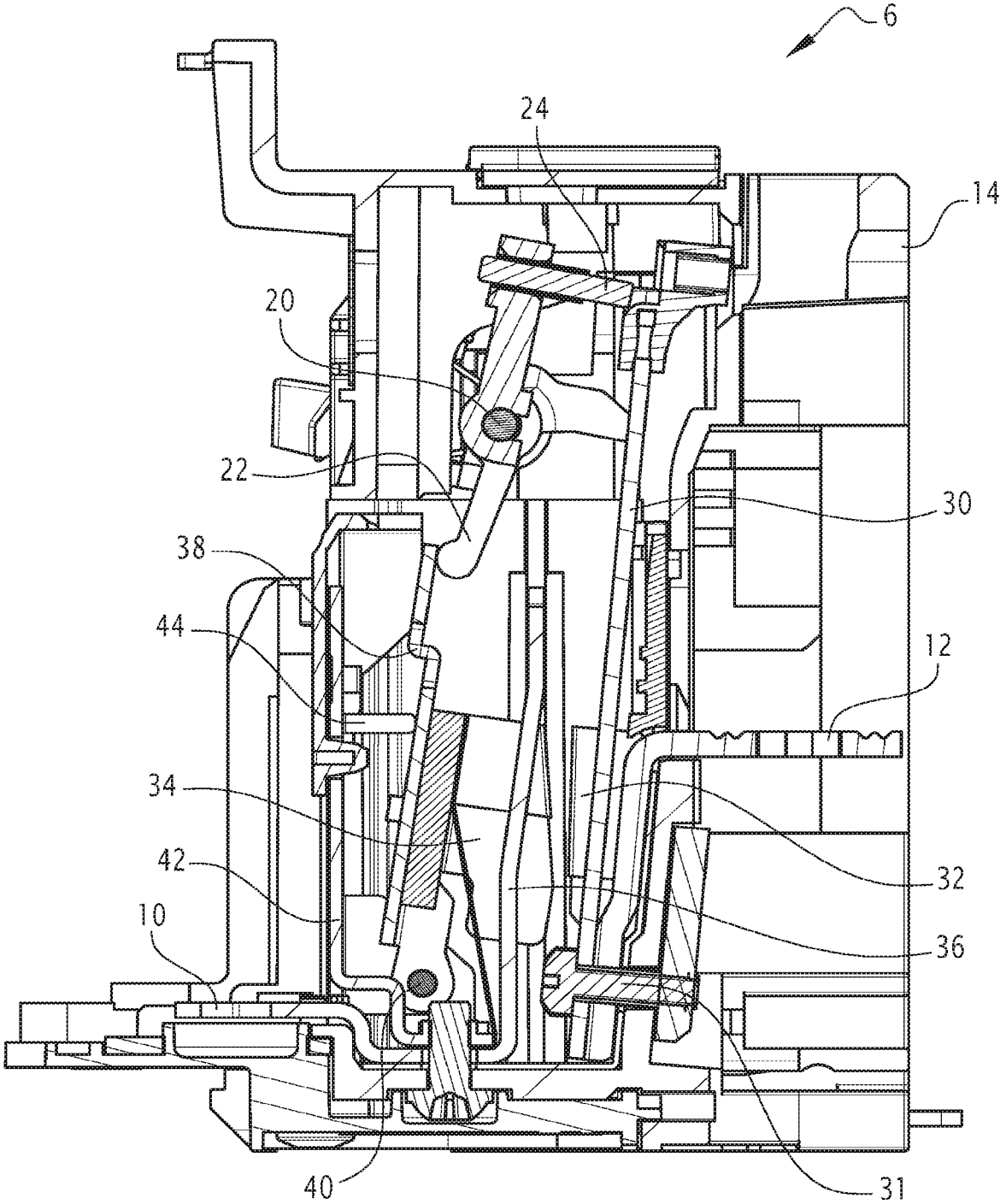
FIGS. 3 and 4 are schematic representations, seen in section, of the trip assembly of FIG. 2.
Figure 4:
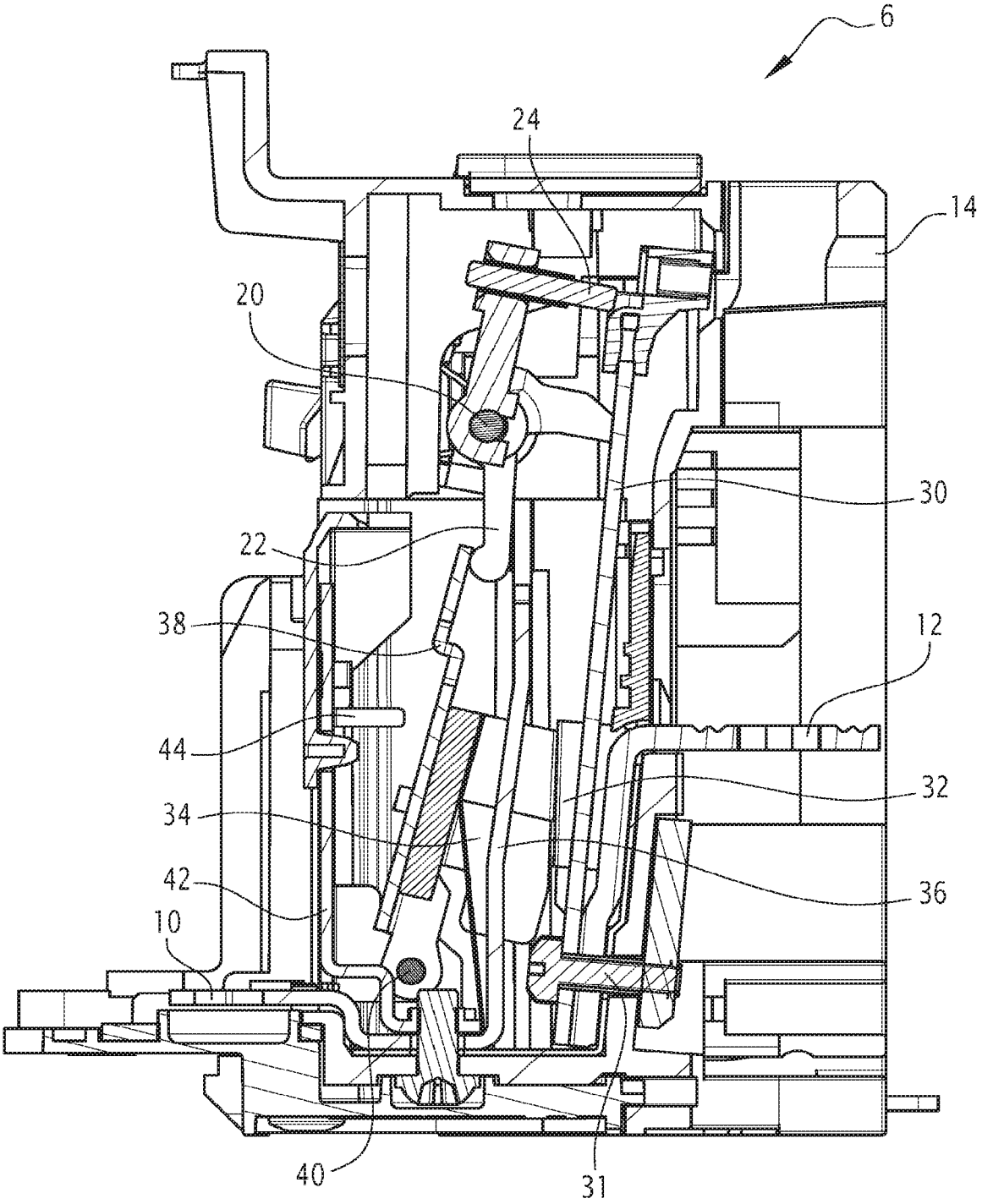

The armature 34 is illustrated in the first position in FIG. 3 and in the second position in FIGS. 2 and 4.

The contact areas correspond to portions of the outer surface of the armatures 32 and 34 at which the armatures 32 and 34 touch one another when the movable armature 34 is in the second position. The reference Z32 refers to the contact area or areas of the armature 32. The reference Z34 refers to the contact area or areas of the armature 34.

The movement of the movable armature 34 toward the second position actuates the actuation lever 22.

The second threshold corresponds, for example, to a tripping threshold for a temporally short fault of short-circuit type. Therefore, it is different to the first threshold.

In a known manner, the armatures 32 and 34 are further provided with magnetic elements. The armatures 32 and 34 thus form a magnetic circuit with a variable gap. The gap in this case is formed by the air present inside the casing and surrounding the armatures 32 and 34. In the second position, there is no gap. In practice, the armatures 32 and 34 at least partially surround the conductor 36 and face one another. When a current flows through the conductor 36, it creates a magnetic force which brings the armature 34 closer to the armature 32.

The operating principle of a magnetic trip is known and is not described in further detail.

Figure 5:
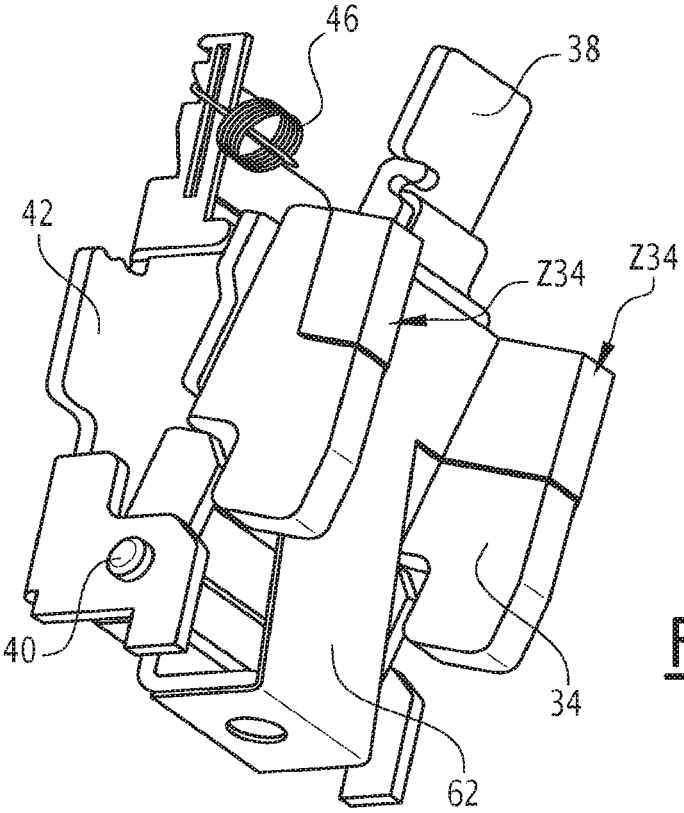
FIGS. 5 and 6 are schematic representations of elements of the trip assembly of FIGS. 2 to 4.
Figure 6:
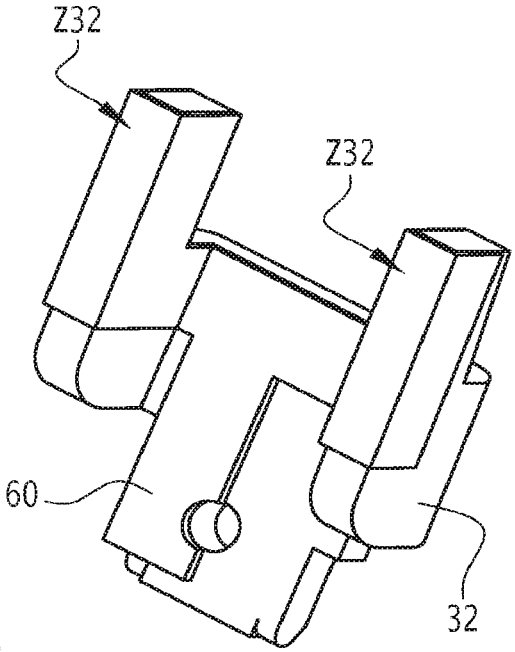

In the embodiment illustrated and described by way of example, the armatures 32 and 34 both have portions, the cross-section of which is U-shaped, each including two arms extending substantially perpendicular from a bottom. As illustrated in FIGS. 5 and 6, the contact areas Z32 and Z34 in this case are located on the ends of the arms.

As illustrated in FIGS. 2, 3 and 4, the assembly 6 includes a mobile blade 38 fixed to the movable armature 34. In this case, the blade 38 is mounted at the rear of the armature 34, given that the front of the armature 34 is directed toward the armature 32. Therefore, it is understood that the blade 38 moves together with the armature 34 between the first and second positions.

The assembly formed by the blade 38 and the armature 34 is mounted in a pivoting manner, thanks to a pivot link 40, with respect to a fixed clamp 42 rigidly connected to the casing 14. Thus, the link 40 allows the armature 34 to move between the first and second positions.

For example, the pivot link 40 includes a rod connected to the clamp 42. An abutment 44 is mounted on the clamp 42 such as to limit the travel of the blade 38 when it returns toward the first position.

The pivot link 40 in this case is provided at the base of the armature 34 and of the blade 38. The upper end of the mobile blade 38 is placed opposite the actuation lever 22, such as to press on the actuation lever 22 when the former moves toward the second position.

Advantageously, the assembly 6 includes a return spring 46, preferably a coil spring, in order to bring the movable armature 34 back toward the first position. For example, the spring 46 is connected to the blade 38 and to the armature 42.

Advantageously, the electric connection between the bimetal strip 30 and the conductor 36 is in this case produced by means of a connection element such as a copper connection braid 48. In an alternative, other elements can be used.

Furthermore, according to preferred modes of implementing the invention, the movable armature 34 is electrically connected to the first terminal 10 via the part 62 and the fixed armature 32 is electrically connected to the second terminal 12 via the part 60.

For example, the armature 32 is electrically connected to the curved portion of the terminal 12 via the part 60 and to the bimetal strip 30 by contact by being held by tightening using the screw 31.

In an alternative, electric connection elements can be used, for example connection braids, or cables or preformed rigid conductors.

In the illustrative diagram of FIG. 1, the element with the reference T symbolises the thermal trip. The elements with the reference M1 and M2 correspond to the magnetic trip. More precisely, the element M2 symbolically represents a switch, in order to illustrate the role played by the movement of the armatures 32 and 34 with respect to one another. The second position corresponds to a conducting state of the switch M2 allowing the current to flow in the branch R2, and the first position corresponds to a blocking state. The element M1 symbolically represents a control for the switch M2, illustrating the role played by the conductor 36 in order to control the movement of the armature 34.

Generally, the electrical conductor 36 and the bimetal strip 30 together form a first branch R1 of an electric circuit such that an electric current flows between the connection terminals 10, 12. Moreover, in the second position, the armatures 32 and 34 in contact with one another form a second branch R2 of the electric circuit such that an electric current flows between the connection terminals 10, 12. This second branch R2 is electrically arranged in parallel with the first branch R1.

Moreover, the first branch R1 has an impedance greater than the impedance of the second branch R2, for example an impedance ten times greater than that of the second branch R2, preferably an impedance one hundred times greater than that of the second branch R2. For example, the difference in impedance between the first and second branches R1 and R2 is partly due to the high impedance of the bimetal strip 30.

Thus, in the second position, the electric current that flows through the assembly 6 between the terminals 10 and 12 is at least partly diverted from the bimetal strip 30 and passes through the armatures 32, 34, since bringing them into contact forms a preferred path for the flow of the current, due to the impedance thereof that is less than that of the first branch R1.

Moreover, according to preferred modes of implementing the invention, the respective contact areas Z32 and Z34 of the fixed armature 32 and of the movable armature 34 are made of electrically conductive materials that exhibit a low degree of mutual weldability.

According to the illustrated implementation modes, each armature 32, 34 includes two contact areas, due to the shape thereof described above. It is understood that, in an alternative, the number of contact areas can be different if the armature 32 and/or the armature 34 have a different shape.

Preferably, the contact areas Z32, Z34 are each formed by an added element 60, 62, fixed on a body of the corresponding fixed or movable armature 32, 34. The added element is, for example, a covering, or a plate, or a sheet, or a contact pad, or any other equivalent element.

As illustrated in FIGS. 5 and 6, in this example, each armature 32, 34 includes an added element, denoted 60 and 62, respectively, on which all of the contact areas Z32, Z34 associated with this armature are formed.

According to non-illustrated alternatives, the armatures 32, 34 are bi-material parts, comprising a main material on which areas are provided that are formed from a different second material to form the contact areas.

According to other alternatives, the armatures 32, 34 are formed from only one material.

The materials forming the contact areas Z32, Z34, which are intended to come into direct contact with one another when the armature 34 is in the second position, are chosen with respect to one another in order to prevent a weld when the electric current flows through the branch R2.

For example, within the meaning of the present description, two materials are said to exhibit a "low degree of weldability" when they do not become mutually welded while they are brought into direct contact with one another and carry an electric current with an intensity of 500 A for a duration of 8 ms, the electric current flowing through a contact surface between the two materials, the surface area of which is less than or equal to 1 $cm^2$. It would also be possible for the materials to not weld together while they are brought into direct contact with one another and carry an electric current with an intensity of 100 A for a duration of 1 ms, the electric current flowing through a contact surface between the two materials, the surface area of which is less than or equal to 1 $cm^2$.

According to embodiments, at least one contact area Z32, Z34 is made from a metal material, chosen from the group including copper, steel, aluminium, Dural alloy, or an alloy of aluminium having the French designation A-G3 or A-G4. Moreover, the materials of the contact areas Z32, Z34 which are part of the fixed and movable armatures 32, 34, respectively, are different.

In this example, the respective bodies of the armatures 32 and 34 are preferably made from steel. This material has a good mechanical strength and makes it possible to effectively channel the magnetic flux generated by the pole elements such as to operate the magnetic trip. For example, in this case steel with a carbon mass concentration of less than 0.2% is used.

The element 60 in this case is a copper plate, fixed on the body of the armature 32.

The element 62 in this case is an aluminium plate, fixed on the body of the armature 34.

Other combinations of materials and other arrangements are, however, possible. In particular, according to other embodiments, one or more contact areas are made of graphite. For example, each contact area Z32, Z34 is formed by a graphite pad added onto the body of the corresponding armature 32, 34. This pad can be directly electrically connected to the corresponding terminal 10, 12 via a dedicated connector.

Thanks to the invention, bringing the armatures 32 and 34 into contact in the second position allows the electric current to flow between the connection terminals 10 and 12 without passing through the bimetal strip 30. This makes it possible to divert at least some of the electric current from the bimetal strip 30. The risk of the bimetal strip 30 overheating is therefore reduced. Moreover, the choice of the materials forming the contact areas Z32, Z34 limits the risk of accidental welding between the armatures 32 and 34 when the electric current passes from one to the other when they are in the second position. The reliability of the trip assembly 6 is thus improved.

The assembly 6 can therefore be used as a thermomagnetic trip for an electrical switching unit having a small current rating, which has satisfactory reliability and durability.

It is striking to note that, in known the thermomagnetic trips, the fixed and movable armatures of the magnetic trip are not intended to carry an electric current, for the purpose of preventing any risk of accidental welding between the fixed and movable armatures, since such welding would be detrimental to the subsequent proper operation of the trip. Thus, the fixed and movable armatures of known magnetic trips are covered with an electrically insulating material in order to prevent them from carrying an electric current. The assembly 6 will therefore go against this technical prejudice, in order to obtain the aforementioned technical advantages.

Advantageously, the contact area or areas Z34 of the movable armature 34 are directly connected to the first terminal 10.

For example, the element 42 extends as far as the base of the armature 34 in order to guide the electric current as far as the terminal 10, preferably preventing the current from passing through the shaft of the pivot link 40.

Advantageously, the contact area or areas Z32 of the fixed armature 32 are directly connected to the second terminal 12.

It is understood that the materials forming the contact areas Z32, Z34 can extend over the corresponding armature 32, 34 outside the contact areas.

The return spring 46, which is preferably a coil spring, is coated with an insulating material. The insulating material is preferably fluoropolymer, for example PTFE, such as the material known by the trademark "Teflon".

The embodiments and the alternatives envisaged above can be combined with one another in order to produce new embodiments.

The invention claimed is:

1. A thermomagnetic trip assembly for an electrical switching unit said assembly comprising:

a thermal trip, a magnetic trip, and a tripping arm intended to be mechanically coupled to a switching mechanism of the electrical switching unit, said tripping arm comprising first and second actuation levers;

the thermal trip comprising a bimetal strip that is capable of deforming when the current passing through it exceeds a first predefined threshold;

the magnetic trip comprises a movable armature, a fixed armature and an electrical conductor;

the movable armature being capable of moving from a first position, wherein the movable armature is distanced from the fixed armature, toward a second position, wherein the movable armature is in contact with the fixed armature at contact areas, when the current which flows through the electrical conductor exceeds a second predetermined threshold, the movement of the movable armature toward the second position actuating the second actuation lever;

the electrical conductor and the bimetal strip being electrically connected in series with one another between first and second connection terminals of the trip assembly;

the movable armature is connected to the first connection terminal, and in that wherein the fixed armature is connected to the second connection terminal, and wherein the respective contact areas of the fixed armature and of the movable armature are made of electrically conductive materials that exhibit a low degree of mutual weldability.

2. The thermomagnetic trip assembly according to claim 1, wherein the contact areas are formed by an added element fixed on a body of the corresponding fixed or movable armature.

3. The thermomagnetic trip assembly according to claim 1, wherein at least one contact area is made of a metal material, chosen from the group comprising copper, steel, aluminium, Dural alloy, an alloy of aluminium having the French designation A-G3 or A-G4, and wherein the materials of the contact areas which are part of the fixed and movable armatures, respectively, are different.

4. The thermomagnetic trip assembly according to claim 1, wherein at least one contact area is made of graphite.

5. The thermomagnetic trip assembly according to claim 1, wherein the contact area or areas of the movable armature are directly connected to the first terminal.

6. The thermomagnetic trip assembly according to claim 1, wherein the contact area or areas of the fixed armature are directly connected to the second terminal.

7. The thermomagnetic trip assembly according to claim 1, wherein the magnetic trip comprises a return spring, in order to bring the movable armature back toward the first position, said return spring being coated with an insulating material.

8. The thermomagnetic trip assembly according to claim 7, wherein the insulating material is Teflon.

9. The thermomagnetic trip assembly according to claim 1, wherein the electrical conductor and the bimetal strip together form a first branch of an electric circuit such that an electric current flows between the connection terminals, wherein, in the second position, the fixed and movable armatures in contact with one another form a second branch of the electric circuit such that an electric current flows between the connection terminals, said second branch being electrically arranged in parallel with the first branch, and wherein the first branch has an impedance greater than the impedance of the second branch.

10. An electrical switching unit comprising:

a cut-off block having separable electrical contacts;

a trip assembly capable of triggering the opening of the electrical contacts of the cut-off block when an electrical fault is detected;

wherein the trip assembly is the thermomagnetic trip assembly according to claim 1.

11. The thermomagnetic trip assembly according to claim 1, wherein the electrical switching unit is a circuit breaker.

12. The thermomagnetic trip assembly according to claim 1, wherein the bimetal strip of the thermal trip is capable of deforming when the current passing through it exceeds the first predefined threshold to actuate the first actuation lever.

13. The thermomagnetic trip assembly according to claim 2, wherein the added element is a covering, a plate, or a contact pad.

14. The thermomagnetic trip assembly according to claim 7, wherein the return spring is a coil spring.

15. The thermomagnetic trip assembly according to claim 9, wherein the impedance of the first branch is ten times greater than the impedance of the second branch.

16. The thermomagnetic trip assembly according to claim 9, wherein the impedance of the first branch is one hundred times greater than the impedance of the second branch.

17. The electrical switching unit according to claim 10, wherein the electrical switching unit is a circuit breaker.

* * * * *